United States Patent [19]

Nichols

[11] Patent Number: 4,872,670

[45] Date of Patent: Oct. 10, 1989

[54] APPARATUS FOR SQUAT EXERCISE

[76] Inventor: Raymond L. Nichols, P.O. Box 412, Cleveland, Tenn. 37311

[21] Appl. No.: 186,615

[22] Filed: Apr. 27, 1988

[51] Int. Cl.[4] ..... A63B 21/00

[52] U.S. Cl. ..... 272/134; 272/117

[58] Field of Search ..... 272/70, 97, 117, 118, 272/120, 123, 130, 134, 136, 142, 143, 144; 128/25 R

[56] References Cited

U.S. PATENT DOCUMENTS

| | | | |
|---|---|---|---|
| 2,783,045 | 2/1957 | Bosch . | |
| 3,003,765 | 10/1961 | Dove . | |
| 3,970,302 | 7/1976 | McFee | 272/130 |
| 4,176,836 | 12/1979 | Coyle | 272/120 |
| 4,236,712 | 12/1980 | Lambert, Jr. | 272/118 |
| 4,316,608 | 2/1982 | Lundberg | 272/117 |
| 4,333,644 | 6/1982 | Lambert, Jr. et al. | 272/118 |
| 4,341,380 | 7/1982 | Sauder | 272/144 X |
| 4,357,010 | 11/1982 | Telle | 272/117 |
| 4,411,424 | 10/1983 | Barnett | 272/118 |
| 4,470,597 | 9/1984 | McFee | 272/70 X |
| 4,535,985 | 8/1985 | Mask | 272/117 X |
| 4,603,855 | 8/1986 | Sebelle | 272/117 |
| 4,621,810 | 11/1986 | Cummins | 272/134 |
| 4,635,926 | 1/1987 | Minkow | 272/118 |
| 4,674,160 | 6/1987 | Gibson | 272/143 X |
| 4,700,946 | 10/1987 | Breunig | 272/134 |

FOREIGN PATENT DOCUMENTS

| | | | |
|---|---|---|---|
| 177017 | 4/1986 | European Pat. Off. | 272/134 |
| 485743 | 3/1976 | U.S.S.R. | 272/117 |

*Primary Examiner*—Richard J. Apley
*Assistant Examiner*—Robert W. Bahr
*Attorney, Agent, or Firm*—Luedeka, Hodges & Neely

[57] ABSTRACT

An apparatus for dynamically exercising the leg and hip muscles employing squat maneuvers. Specifically, the apparatus includes a base on which the user stands and a back support that is mounted such that it maintains a vertical attitude while being moved by the user along a arcuate path as the user performs a squat movement with his back in contact with the back support. The controlled movement of the back support is accomplished by first and second parallelogram-type side assemblies so mounted with respect to the base at one of their respective ends and having the back supported therebetween adjacent their outboard ends, that such side assemblies provide pantographic type motion to the back support. Shoulder blocks associated with the back support are adjustable to accommodate users of various physical heights.

12 Claims, 5 Drawing Sheets

APPARATUS FOR SQUAT EXERCISE

FIELD OF THE INVENTION

This invention relates to exercise methods and apparatus and particularly to a method and promoted in connection with dynamically exercising the leg and hip muscles employing squat maneuvers.

BACKGROUND OF THE INVENTION

In the prior art, exercise of the leg muscles, and particularly the large leg muscles, commonly is presented in connection with a "hack squat" machine such as described in U.S. Pat. No. 4,333,644. Whereas this machine is said to effectively isolate the muscles to be exercised, it is this feature that results in limiting the exercise possible with this machine to those leg (and back) muscles that lift (or lower) the torso along a straight line path. This type of motion is unnatural and calls into play less than all the muscles sought to be exercised. Being an unnatural movement, the exercise motion further fails to provide the kind and range of motions that strengthen those muscles employed in natural squatting activities and particularly does not include those muscles that aid in rotation of the femur in the hip joint.

Other known leg exercise devices employ vertical lifting of weights using the legs as with barbells or as by lying on one's back and using the legs to perform vertical pushups of weights. These and other devices present known dangers to users such as injury to the user in the event of muscle cramps, fatigue, or slips. Likewise, they are not capable of effectively and efficiently accommodating selectable degrees of motion.

SUMMARY OF THE INVENTION

Recognizing the limitations, dangers, etc. of the prior art, the present inventor has discovered a novel and safe apparatus for efficiently exercising the leg muscle group, and including the gluteus group. Accordingly, it is an object of the present invention to provide a novel apparatus for exercising leg muscles.

It is another object of the present invention to provide apparatus of the type described wherein the user's motions closely imitate the natural squatting motions.

It is another object of the present invention to provide an apparatus of the type described wherein the apparatus is of uncomplicated construction.

It is another object of the present invention to provide an apparatus of the type described which is adjustable to accommodate individual users of different physical statures.

It is another object of the present invention to provide an apparatus of the type described which is capable of accommodating different degrees of squatting motion.

It is another object of the present invention to provide a novel method for exercising the leg muscles.

In accordance with the present invention, there is provided a method and apparatus for exercising the leg and hip muscles employing motions that approximate closely the natural squatting movements. Specifically, the apparatus includes a base on which the user stands and a back support that is mounted such that it maintains a vertical attitude while being moved by the user along an arcuate path as the user performs a squat movement.

Such controlled movement of the back support is accomplished by means of first and second parallelogram-type side assemblies so mounted with respect to the base at one of their respective ends and having the back support supported therebetween adjacent their outboard ends, that such side assembles provide pantographic type motion to the back support. Shoulder block means associated with the back support are adjustable to accommodate users of various physical heights so that the squat performed is substantially that which is natural and normal for the user regardless of the user's height. Moreover, such height selection further accommodates the user's leg length, thereby avoiding the possibility of undesirable excessive and unnatural strain being placed upon the user's legs and/or back and particularly the user's knees.

In accordance with the method, the user's back is maintained substantially in contact with a back support which is guided along an arcuate path while maintaining the upright orientation as the user performs a squat maneuver. Stop means is provided for selectively limiting the squat maneuver to ¼ squat, ½ squat or full squat.

BRIEF DESCRIPTION OF THE DRAWINGS

Other objects and advantages of the present invention will be recognized from the description contained herein, including the drawings in which.

DETAILED DESCRIPTION OF THE INVENTION

Figure 1:
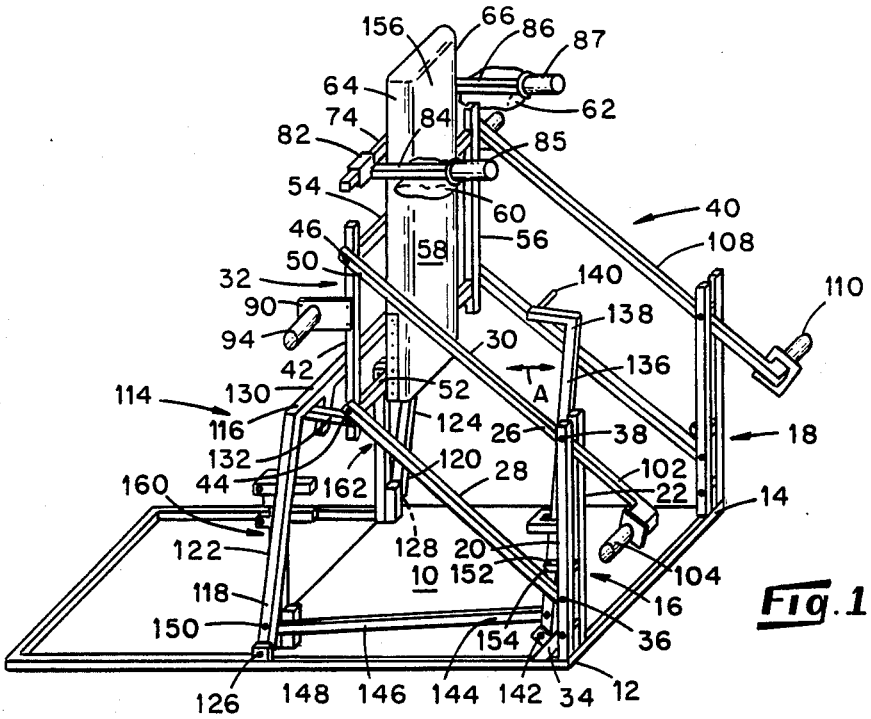
FIG. 1 is a representation of one embodiment of an exercise apparatus in accordance with the present invention.
Figure 2:
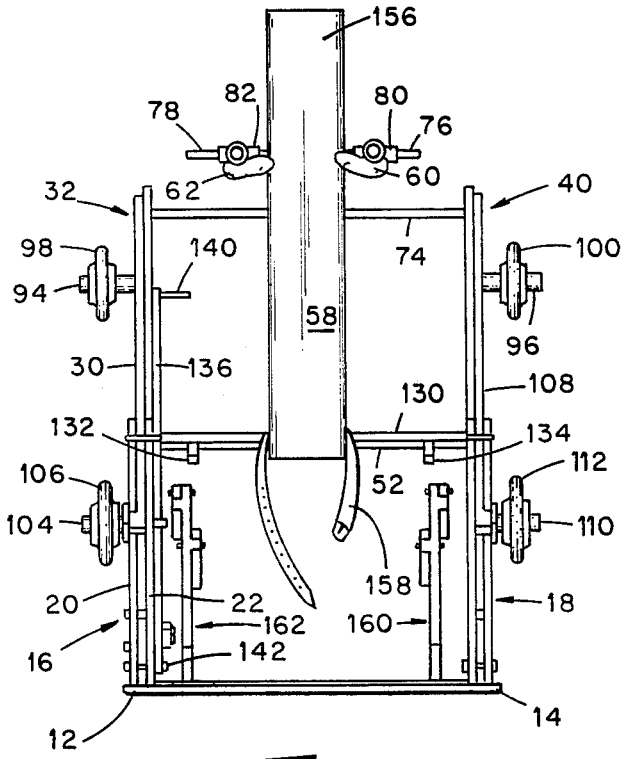
FIG. 2 is a front elevation view of the apparatus depicted in FIG. 1.

Referring now to FIG. 1 wherein there is depicted a preferred embodiment of the present exercise machine, there is provided a base 10 which may be a floor, but in the depicted embodiment comprises a flat metal tread plate which serves as a mount for the user of the machine. At the opposite front corners 12 and 14 of the base there are mounted upright standards 16 and 18. Each standard comprises first and second lengths 20 and 22 of parallel solid metal bar stock, preferably rectangular in cross-section, disposed in side-by-side and spaced apart relationship to provide a rigid support for pivotally receiving therebetween the ends 24 and 26 of a pair of leg members 28 and 30 of a first parallelogram side member indicated generally at 32. Each standard is securely anchored to the base and may be reinforced as by a gusset 34 so that the standard does not yield under the forces exerted thereagainst during use of the machine as will appear more fully hereinafter. Each standard 16 and 18 define a first upright leg of a respective parallelogram side member. Pins 36 and 38 provide for the pivotal connection of the legs 28 and 30 to the upright standard. The standard 18 on the opposite corner of the base is mounted essentially identically to the mounting of the standard 16 and provides for pivotal mounting of a second parallelogram side member indicated generally at 40. The two parallelogram side members are essentially identical and a description of one will suffice for an understanding of the other.

The first parallelogram side member 32 includes a further outboard leg member 42 that is pivotally secured as by pins 44 and 46 to the outboard ends 48 and 50 of the legs 28 and 30. The design of the side member 32 is such that the outboard leg 42 is at all times maintained parallel to the upright standard 16 as the leg 42 is moved upwardly, such being in the nature of pantographic movement of the leg 42. In one embodiment of the depicted machine, the upright standard is approximately 28 inches tall with the locations of the pins 36 and 38 being 22 inches apart on centers. The pivot pins 36 and 48 of the leg 28 are spaced apart by 40 inches on centers and the legs 28 and 30 are parallel to one another, thereby positioning the pivot pins 44 and 46 spaced apart by 22 inches.

Elongated cross frame members 52 and 54 extend between the legs 42 and 56 of the opposite parallelogram side members 32 and 40 to connect these side members for simultaneous and identical movement. These cross frame members further serve to mount an upright planar back support 58 in a location substantially midway between the side members 32 and 40.

The cross frame members 52 and 54 further serve to mount a pair of shoulder blocks 60 and 62 that project forwardly from opposite sides 64 and 66 of the uppermost portion of the back support. Such mounting includes a hollow tubular member 68 fixedly secured to the cross frame members 52 and 54 and a bar member 70 that is telescopically received within the hollow tubular member 68. The upper end 72 of the bar 70 has secured thereto a horizontal cross member 74 which preferably is of rectangular cross section. The outboard ends 76 and 78 of the cross member 74 serve to slidably receive thereon collars 80 and 82. To the collar 82 there is anchored a pad arm 84 that projects from the collar in cantilevered fashion along the side edge of the back support to receive the shoulder block 60. The collar 80 likewise serves to mount a further pad arm 86 that projects forwardly along the opposite side edge 66 of the back support to receive the shoulder block 62. Thus it may be seen that the lateral spatial separation of the shoulder blocks may be readily selected by means of the positions of the collars 80 and 82 that are slidable along the respective outboard ends of the cross member 74. Further, the vertical position of the the cross member 74, hence the vertical positions of the shoulder blocks 60 and 62 is selectable by moving the bar 70 within its hollow tubular mount 68. Holes (not shown) are provided through the hollow tubular mount 68 and through the bar 70 so that as such members are moved in and out of their telescoping relationship, such holes come in register and the two members can be rigidified with respect to one another as by a removable pin 88. Each of the shoulder blocks is provided with a handle portion 85 and 87, respectively, suitable to serve as handholds for the user while engaging in exercising maneuvers.

In the depicted embodiment, provision is made for the addition of removable weights to thereby select the resistance to lifting to be encountered by the user of the apparatus. Specifically, each of the outboard legs 42 and 56 has fixedly secured thereto a bracket 90 and 92, respectively, which serves to mount a horizontally oriented cantilevered shaft 94 and 96, respectively. Each of these shafts 94 and 96 is adapted to receive thereon removable weights 98 and 100.

Figure 3:
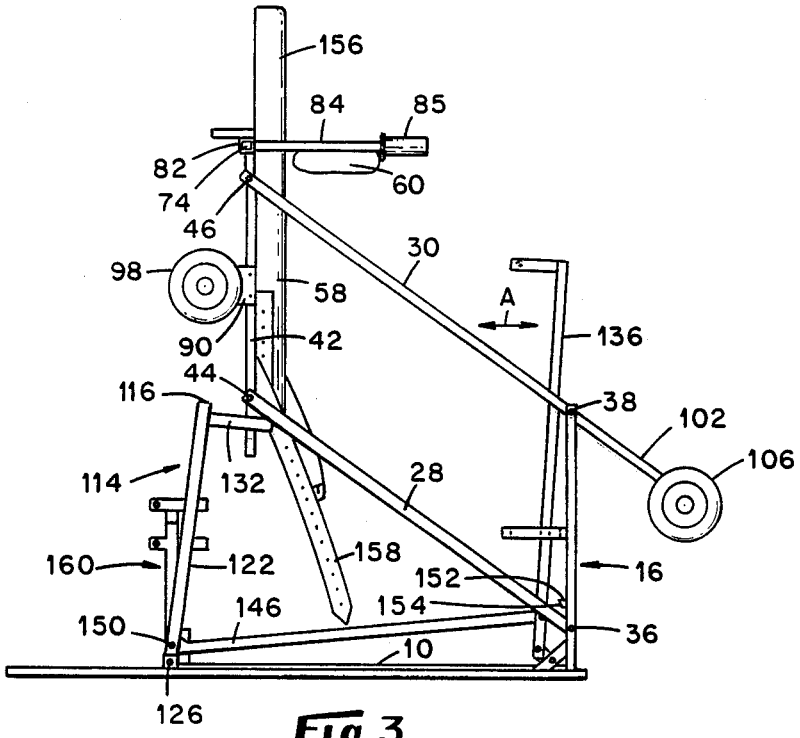
FIG. 3 is a right side elevational view of the apparatus depicted in FIG. 1.
Figure 4:
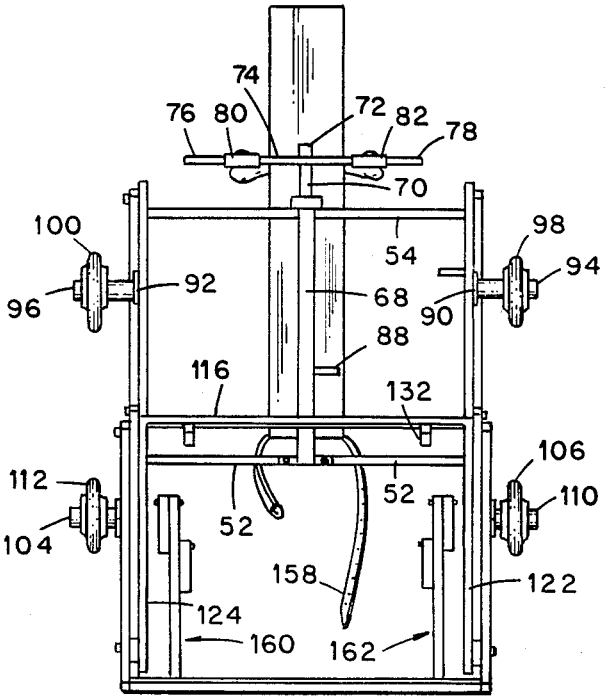
FIG. 4 is a rear elevational view of the apparatus depicted in FIG. 1.

As best seen in FIGS. 1 and 3, the upper leg 30 of the parallelogram side member 32 is extended forwardly from the upright standard 16 a distance sufficient to provide a cantilevered outboard end 102 of the leg 30. To this outboard end 102 there is mounted a shaft 104 which is also adapted to receive thereon a removable weight 106. The opposite leg 108 on the further parallelogram side member 40 is essentially identically extended in cantilevered fashion forwardly of the vertical standard 18 to provide a shaft 110 onto which there may be mounted a removable weight 112.

With reference to the several FIGURES, it will be readily recognized that the apparatus is weighted such that the back support and the structure surrounding the back support will tend to move downwardly into contact with the base 10 unless otherwise restrained against such movement. In the depicted embodiment, such restraint of downward movement of the back support and surrounding structure is affected by means of a catch indicated generally at 114, and which comprises a U-shaped frame member 116. The opposite ends 118 and 120 of the legs 122 and 124 of the U-shaped frame member 116 are pivotally mounted to the base as by pins 126 and 128. The horizontal leg 130 of the U-shaped frame member is provided with lugs 132 and 134 which project under the cross frame member 52 and serve as a stop against downward movement of the cross frame member and its associated apparatus, including the side assemblies and the back support. The outboard ends of the lugs 132 and 134 are provided with stop lugs to aid in preventing inadvertent withdrawal of the lugs from their position of support for the cross member 52 and associated framework (only stop lug 131 is depicted, see FIGS. 5A, B and C).

Pivotal movement of the catch 114 between "engaged" and "released" positions is accomplished by means of a lever arm 136 disposed near and in front of the user. The upper end 138 of the lever arm 136 is provided with a handle 140 which may be grasped by the user to move the lever arm forwardly or rearwardly as indicated by the arrow "A" in FIG. 1. The lower end of the lever arm 136 is pivotally mounted as by a pin 142 to the gusset 34 that extends from the standard 16 to the base 10. At a location slightly above the pin 142, the lever arm pivotally receives one end 144 of a connecting rod 146 that extends rearwardly along the side edge of the apparatus to the leg 122 of the catch 114. The rearward end 148 of the connecting rod 146 is pivotally pinned at 150 to the leg 122. By means of the depicted apparatus, movement of the lever arm 136 rearwardly, acting through the connecting rod 146 upon the U-shaped frame member 116, moves the catch between positions of engagement ("engaged") and disengagement ("released") with the lower edge of the frame cross member 52, As best seen in FIG. 3, the angularity of the U-shaped frame member 116 with respect to the base 10 when the lever arm 136 is in its most forward position, is such that the cantilevered lugs 132 and 134 extending from the U-shaped member 116 are directed downwardly at a slight angle. By this means, when the back support and its surrounding apparatus are in contact with the lugs 132 and 134, the resultant vectorial force against the lugs 132 and 134 is in a direction that inhibits withdrawal of the catch 114 from its position of support for the back support and its surrounding frame work. By this means, there is prohibited inadvertent withdrawal of the catch at all times except when the user purposefully pulls forward on the handle 140 to move the catch out of its supporting position with respect to the back support. The angularity referred to above and the resultant vectorial direction of the downward force of the back support results in sufficient resistance to withdrawal of the catch of a nature that is transmitted to the handle 140 thereby requiring the user to exert a substantial rearward pull on the handle in order to release the back support for downward movement. As noted hereinbefore, two vertical stops, each approximately 2" tall, are attached onto the ends of lugs 132 and 134. These act as a safety mechanism to prevent accidental disengagement of back support frame from the U-shaped frame.

With reference to FIGS. 1 and 3, in particular, there is provided on the upright standard 16 a stop 152 having a forward edge 154 that is inclined at an angle of about 45 degrees with respect to the horizontal. This stop is in position such that upon the upward movement of the leg 28 of the side member 32 the leg 28 engages the angular face of the stop to prevent further upward movement of the leg 28, hence limit the upward motion of the back support 58. By this means, the inventor provides for a maximum upward movement of the back support 58.

Figure 5A:
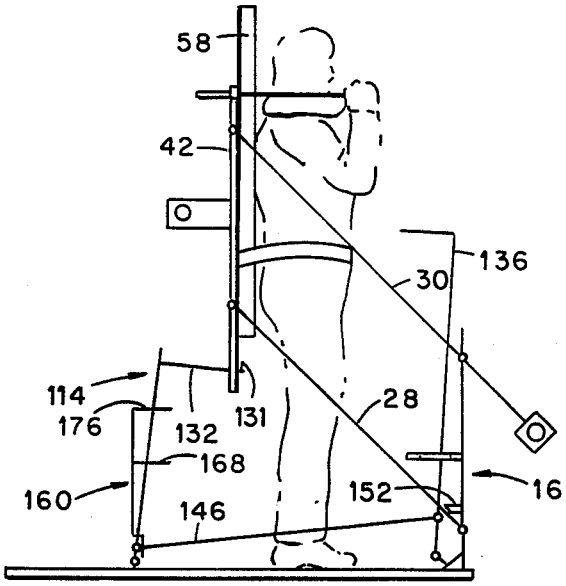
FIGS. 5A–C are illustrations of the apparatus depicted in FIG. 1 as used in three different positions of a squat exercise.
Figure 5B:
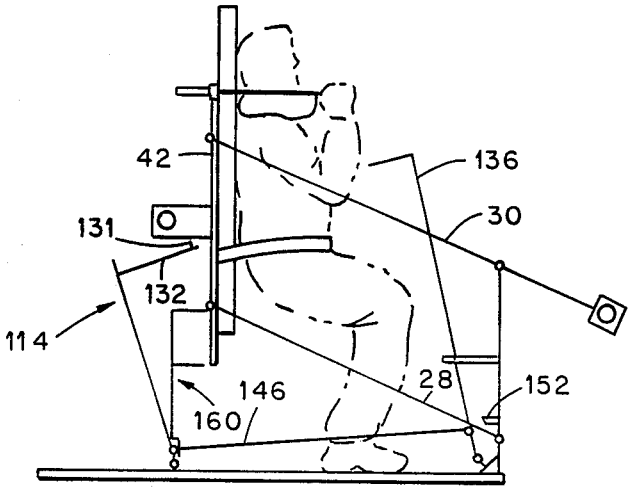
Figure 5C:
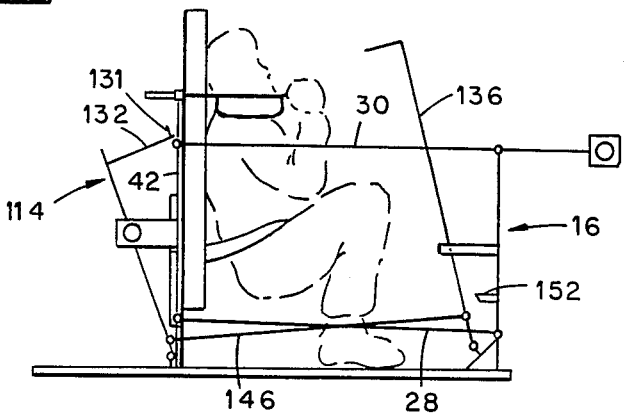

With reference to FIGS. 5A–C, at the beginning of an exercise routine employing the apparatus of the present invention, the back support is positioned in its uppermost and locked ("engaged") position. The user then positions himself between the side frame assemblies with his back parallel to and in contact with the forward surface 156 of the back support 58. It will be recognized that the legs of the user are straight and therefore, the entire body of the user is fully erect. Thereupon, the shoulder blocks are adjusted vertically to come to rest on the shoulders of the user and are adjusted laterally to positions of comfort on the shoulders. The adjusted positions of the shoulder blocks are secured as required.

Thereupon, the user may withdraw from the apparatus and place the desired weights on the shafts associated with the back support and/or the shafts 104 and 110. In most instances, no weights are required on the forwardly projecting leg portions, i.e. shafts 104 and 110. In one embodiment of the present apparatus, the back support and the associated side frame assemblies and other frame work associated with the back support, weigh approximately eighty pounds. If a user desires to perform squat exercises employing less than eighty pounds, counterweights may be added to the shafts 104 and 110 on the cantilevered leg portions. As indicated, however, it is normal that greater than eighty pounds be used to provide lifting resistance during the squat maneuvers so that weights commonly are only added to the shafts 94 and 96 associated with the back support. Once the weights are in position, the user may return to the erect position with his back against the back support and his shoulders against the shoulder blocks. As desired, a belt means 158 is provided on the back support for assisting and maintaining the user's body in good contact with the back support during squatting maneuvers. Once the user feels comfortable with the apparatus setup, he reaches forward and pulls the handle 140 on the lever arm 136 toward him, thereby releasing the catch 114 of the back support. FIGS. 5B and 5C show this catch in its "released" position.

Figure 7:
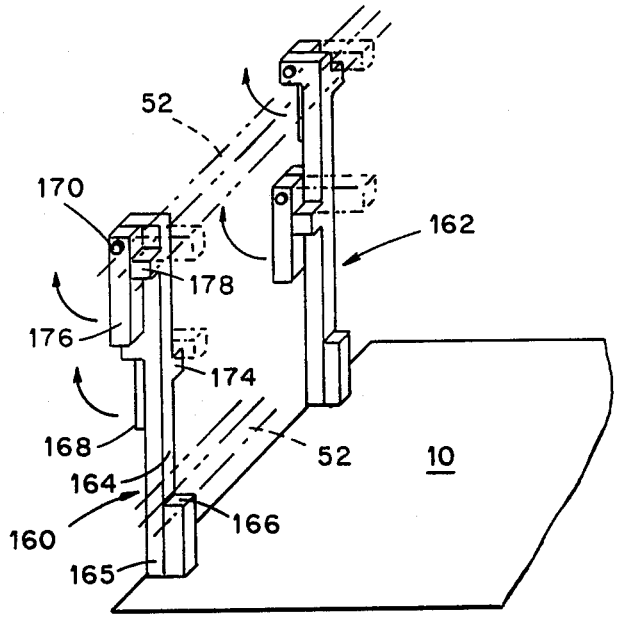
FIG. 7 is a fragmentary representation of a stop subassembly for use in selectively limiting the exercise motion to either ¼ squat, ½ squat or full squat.

Thereupon, the user grasps the handholds on the shoulder blocks and performs a squat maneuver as depicted in FIGS. 5B and C. In a preferred embodiment, the lowermost limit of the squat maneuver is selectively established by means of a pair of elevator towers 100 and 162. Each tower of the depicted embodiment (see FIG. 7) comprises an upright standard 164 whose lowermost end 166 is fixedly secured to the base 10 and extends upwardly to a location below the cross member 52 when such cross member is at rest on the catch 114. Adjacent the lowermost end 165 of each standard there is provided a first stop 166, which in one embodiment, halts downward movement of the cross member 52 at a height of about 4 inches above the base. This is the lower limit of a full squat. At a second height along each standard, there is pivotally mounted an arm 168 which swings freely about a pivot pin 170 that extends through one end of the arm and through a projection 172 on the standard. A shoulder stop 174 is provided on the standard in position such that when the arm 168 is rotated to a horizontal position (see dotted line position in FIG. 7), the arm comes to rest against the shoulder stop 174 and projects inwardly into the downward path of the cross member 52. When the cross member 33 contacts the arm 168, this stops the downward movement of the cross member and establishes the lower limit of a ½ squat maneuver. At a further height on the standard 164 there is pivotally mounted a further stop arm 176. When this further stop arm 176 is rotated to its horizontal position, it contacts a further shoulder stop 178 on the standard and thereby projects into the downward path of movement of the cross member 52 to halt such downward movement. This establishes the lower limit of a ¼ squat maneuver. As seen in FIG. 7, the elevation tower 162 is substantially identical in construction and function as the elevation tower 160 and the two combine to provide certainty in halting the downward movement of the cross member 52 at the selected positions.

The squat maneuver is completed by lifting the weighted back support to its uppermost position as shown in FIG. 5A. These procedures are repeated as many times as recommended for proper exercise of the muscles in the legs and hips. Upon completion of the desired number of squat maneuvers, the user pushes the handle 140 away from himself thereby returning the catch 114 to its "engaged" position with respect to the back support to lock the back support against downward movement, thereby permitting the user to extract himself from the apparatus.

Figure 6:
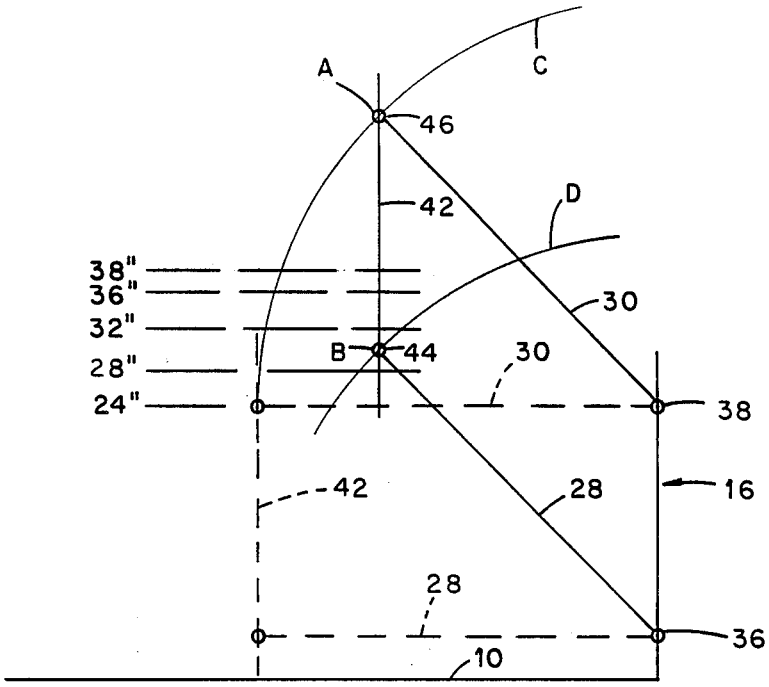
FIG. 6 is a representation of one embodiment of the apparatus of the present invention and depicting various relationships of several parts of the apparatus.

With reference to FIG. 6, there is depicted schematically the pantographic movement referred to in the present application. Specifically, it is noted that the pivot points A and B of the back support 58 move through arcs "C" and "D", respectively, in the cource of the user performing squat maneuvers. In FIG. 6, the back support 58 is depicted as being in its uppermost position. In FIG. 6, the horizontal lines labeled 24", 28", 32", 36", and 38", are indicative of the location of the crotch of the user when his feet reside flat on the base 10, his body is fully erect and his back is in contact with the back support 58. Thus, it may be seen that a short person or a rather tall person may readily utilize the present apparatus by merely adjusting the vertical height of the shoulder blocks (as well as the lateral width between the shoulder blocks). As the user performs the squat maneuvers, the back support remains vertical as indicated in FIG. 6, thereby ensuring that the lifting forces exerted against the shoulder blocks are developed almost solely by the leg and hip muscles of the user as opposed to the muscles of the back or upper body. It will further be recognized that the squatting maneuver performed by the user employing the present apparatus simulates a natural squat requiring utilization of those muscles commonly employed in natural squatting maneuvers.

In the depicted embodiment, the lowermost position of the side assemblies, hence the lowermost position of the back support 58 is limited by the selected stop on the elevation towers. Recalling that the legs of the side assembly preferably can move upwardly only to a maximum angle of 45 degrees with respect to the horizontal, (by reason of the stop 152), it will be recognized that the maximum squat exercise will involve movement of the back support along the arc "D" whose length is defined by the distance between the pivot pins 36 and 44, and a 45 degree angular movement of the leg 28. Such arcuate distance is translated into vertical repositioning of the back support by reason of the pantographic nature of its mounting.

As desired, the degree of squat may be limited to less than the maximum 45 degree movement. In one embodiment, this may be accomplished by selecting the appropriate stops on the elevation towers to thereby establish different lowermost limits of movement of the back support 58, i.e. ½ squat or ¼ squat. Such limited squat maneuvers are desirable for certain recuperative exercises or for persons of limited ability to perform a full squat.

Whereas preferred and specific embodiments of the invention have been depicted and described, it will be apparent that various modifications and equivalent embodiments are possible without departing from the scope of the invention. For example, the individual elements of the apparatus may be constructed of various materials, the back support may be contoured to partially wrap the user's back, the location and method of mounting the weights may be varied, and/or means other than that depicted may be employed to limit the degree of angular movement of the side assemblies.

What is claimed:

1. Apparatus for exercising the muscles of the legs and hips of a user comprising:

a substantially horizontal base means;

first and second side members, each such side member defining a parallelogram, including first, second, third and fourth leg means, said first leg being fixedly secured uprightly with respect to said base means, said second and third leg means having one of their respective ends pivotally connected to said first leg means at spaced apart locations along the length of said first leg means and extending therefrom in substantially parallel relationship to one another, said fourth leg means being pivotally connected to the outboard ends of said second and third leg means at spaced apart locations along the length of said fourth leg means whereby when said second and third leg means are pivoted about their respective points of connection with said first leg, said fourth leg means moves along an arcuate path but is maintained substantially parallel to said first leg means;

said first and second side members being spaced apart from one another;

back support means mounted between said first and second side members and movable therewith;

shoulder contact means associated with said back support means and adapted to receive the shoulders of a user of the apparatus when the back of such user is in contact with said back support means for exerting a lifting force to said back support means.

2. The apparatus of claim 1 wherein said base means comprises a planar substantially horizontal platform.

3. The apparatus of claim 1 including means associated with said back support for receiving removable weights thereon.

4. The apparatus of claim 1 wherein said back support is movable along an arcuate defined by a pivot angle of about 45 degrees of said second and third leg means relative to said first leg means.

5. The apparatus of claim 1 including at least one elevation tower providing for selectively limiting the lowermost limit of downward movement of said back support means.

6. Apparatus for exercising the muscles of the legs and hips of a user comprising:

a substantially planar base means;

first and second side frame members, each such side member defining a parallelogram having a first one of its legs fixedly supported by said base means, second and third parallel ones of its legs pivotally secured to said first leg and extending therefrom, and a fourth leg pivotally secured to the outboard ends of said third and fourth legs whereby said fourth leg is movable up and down with respect to said first leg while being maintained parallel to said first leg;

back support means rigidly mounted between said respective fourth legs of said first and second side frame members and substantially parallel to said fourth legs of said first and second side side frame members; and shoulder contact means associated with said back support means and adapted to receive the shoulders of a user of the apparatus when the back of such user is in contact with said back support means for exerting a lifting force to said back support means.

7. Apparatus for exercising the muscles of the legs and hips of a user comprising:

generally horizontally oriented base means;

first upright means;

second upright frame means spaced apart from said first upright frame means;

a first side assembly comprising a pantographic assembly, including a first upright leg comprising said first upright frame means, substantially parallel elongated leg frame members pivotally connected to said first upright frame means and further pivotally connected at their opposite respective ends to a further elongated upright leg means disposed outboard of said first upright frame means and oriented substantially parallel thereto;

a second side frame means substantially identical to said first side frame means and disposed in a plane that is spaced apart from and substantially parallel to the plane within which said first side frame means resides;

back support means mounted uprightly between said first and second side frame means in the vicinity of the outboard further elongated upright frame means of said pantographic side frame means, thereby positioning said back support means for pantographic movement with respect to said first and second fixed upright frame members; and shoulder block means associated with said back support means and projecting therefrom in position to be engaged by the shoulders of a user when the back of said user is in contact with said back support means to permit the user to exert a lifting force against said shoulder block means.

8. Apparatus for exercising the muscles of the legs and hips of a user initially positioned in a substantially full upright position comprising:

a generally horizontally oriented base member;

first upright frame means upstanding from and rigidly supported by said base means;

second upright frame means upstanding from and rigidly supported by said base means at a location spaced apart from said first upright frame means;

a first side frame assembly comprising an elongated leg means pivotally mounted to said first upright frame means at a first level spaced above said base means, a further elongated leg means pivotally mounted to said first upright frame means at a second level spaced above said base means and further spaced above said first level and an upright leg means pivotally mounted to the outboard ends of said elongated legs at locations along the length of said upright leg means such that said elongated legs, said upright leg means and said first upright frame means define a parallelogram and provide for pantographic movement of said upright leg means relative to said fixed first upright frame means;

a second side frame assembly comprising an elongated leg pivotally mounted to said second upright frame means at a first level spaced above said base means, a further elongated leg pivotally mounted to said second upright frame means at a second level spaced above said base means and further spaced above said first level, and an upright leg means pivotally mounted to the outboard ends of said elongated legs at locations along said upright leg means such that said legs, said upright leg means and said second upright frame means define a parallelogram and provide for pantographic movement of said upright leg means relative to said fixed second upright frame means;

back support means mounted uprightly between said first and second side frame assemblies in the vicinity of the outboard ends of said elongated legs of said first and second side frame assemblies thereby positioning said back support for pantographic movement with respect to said first and second fixed upright frame members; and shoulder block means associated with said back support means and projecting therefrom in position to be engaged by the shoulders of a user when the back of said user is in contact with said back support means to permit the user to exert a lifting force against said shoulder block means, hence against said back support means.

9. The apparatus of claim 8 and including means mounting said shoulder block means for vertical positioning thereof relative to said back support means.

10. The apparatus of claim 8 and including means selectably engaging said side frame assemblies for limiting the downward movement of said back support means.

11. The apparatus of claim 8 wherein at least one of said elongated legs projects from its respective pivotal mounting with its upright fixed frame member in cantilevered fashion in a direction away from said back support means and including means associated with said projecting portion to receive weights thereon to serve as a counterbalance.

12. The apparatus of claim 8 and including means associated with said back support means for mounting weights thereon.

* * * * *